United States Patent [19]

Tse

[11] Patent Number: 5,023,543

[45] Date of Patent: Jun. 11, 1991

[54] TEMPERATURE COMPENSATED VOLTAGE REGULATOR AND REFERENCE CIRCUIT

[75] Inventor: Lawrence T. Tse, Nepean, Canada

[73] Assignee: Gennum Corporation, Burlington, Canada

[21] Appl. No.: 407,993

[22] Filed: Sep. 15, 1989

[51] Int. Cl.[5] ..... G05F 3/20

[52] U.S. Cl. ..... 323/314; 323/907; 307/296.7

[58] Field of Search ..... 323/311, 312, 313, 314, 323/907; 307/296.1, 296.6, 296.7

[56] References Cited

U.S. PATENT DOCUMENTS

| | | | |
|---|---|---|---|
| 3,899,693 | 8/1975 | Gaudreault | 323/907 |
| 4,100,478 | 7/1978 | Tam | 323/907 |
| 4,716,356 | 12/1987 | Vyne et al. | 323/312 |
| 4,843,303 | 6/1989 | Shoji | 323/314 |

*Primary Examiner*—Peter S. Wong

*Attorney, Agent, or Firm*—Rogers, Bereskin & Parr

[57] ABSTRACT

The temperature compensated reference circuit has a first common emitter BJT whose base is connected to a first JFET current source and through a JFET resistor to a voltage output. The JFET resistor is biased in the linear region and the JFET current source is biased in the saturation region in an operating condition. The voltage across the JFET resistor is selected to be approximately equal to the pinch-off voltage of the JFET current source. The temperature co-efficient of the first BJT and JFET resistor will cancel one another to produce a generally temperature invariant voltage at the output. The voltage regulator incorporates the reference circuit and has a second BJT current source driving the reference circuit. A feedback system includes a second JFET current source between the collector of the first BJT and the connection between the voltage output and the collector of the second BJT. The second JFET current source drives the base of a common emitter third BJT. The collector of the third BJT is connected through a resistor to the base of the second BJT. The feedback system regulates the amount of current necessary to drive the reference circuit and the load.

15 Claims, 2 Drawing Sheets

TEMPERATURE COMPENSATED VOLTAGE REGULATOR AND REFERENCE CIRCUIT

FIELD OF THE INVENTION

This invention relates to voltage regulators and to voltage reference circuits. More particularly, it relates to temperature compensation in regulators and reference circuits.

BACKGROUND OF THE INVENTION

Temperature compensation of voltage regulators has long been a problem. The reference voltage of regulators has typically been produced by adding a BJT base emitter junction voltage (VBE) to another derived voltage which is proportional to absolute temperature (PTAT). The simplest implementation of this method to achieve zero temperature co-efficient (ZTC) produces a reference voltage of 1.26 volts which is the popular bandgap voltage. With an adequate supply voltage and additional amplification circuitry this reference can be multiplied up or divided down to produce any value of regulated ZTC voltage.

These circuits however are not suitable for low supply voltage operation (1.3 volts or less) which is often required in battery operated circuits as there is not enough voltage to operate the simple band gap reference let alone the amplification circuitry required for regulation. In order to overcome this problem complicated circuitry has been used to implement essentially the same idea. This is accomplished by combining the right proportions of a VBE to produce some desired ZTC reference voltage which is less than the bandgap voltage.

SUMMARY OF THE INVENTION

In a first aspect the invention provides a voltage reference circuit, having a voltage output, the circuit comprising: a Bipolar Junction Transistor (BJT) having a common emitter; a Junction Field Effect Transistor (JFET) current source having a given pinch-off voltage; and a JFET resistor; wherein, the current source is connected to the base of the BJT, the JFET resistor is connected between the voltage output and the base of the BJT, and the JFET resistor is selected to produce a voltage approximately equal to the pinch-off voltage of the current source when the circuit is biased in an operating condition.

In a second aspect the invention provides a voltage regulator, having a voltage output, the regulator comprising:

a first current source;

a first BJT having a common emitter;

a JFET second current source; and a JFET resistor wherein, the second current source is connected to the base of the first BJT, the JFET resistor is connected between the voltage output and the base of the first BJT, the first current source is connected to the voltage output, the first current source drives the collector of the first BJT, and the JFET resistor is selected to produce a voltage approximately equal to the pinch-off voltage of the second current source when the circuit is biased in an operating condition.

BRIEF DESCRIPTION OF THE DRAWINGS

For a better understanding of the present invention, and to show more clearly how it may be carried into effect, reference will now be made, by way of example to the accompanying drawings, which show a preferred embodiment of the present invention, and in which.

DETAILED DESCRIPTION OF THE PREFERRED EMBODIMENT

Figure 1:
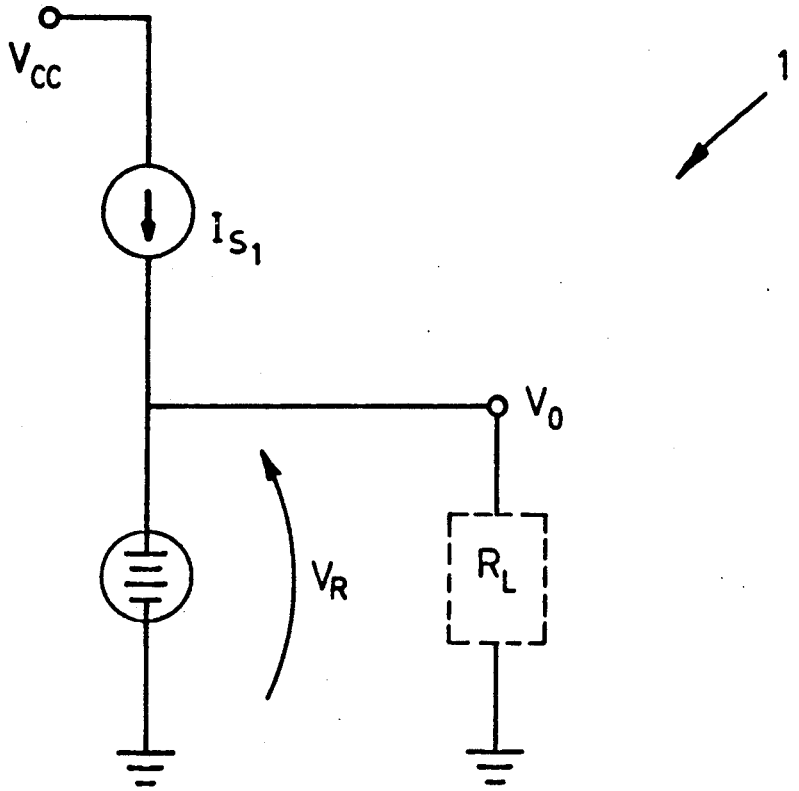
FIG. 1 is a schematic diagram of a voltage regulator according to the preferred embodiment of the present invention.

Referring to FIG. 1 a voltage regulator 1 has an unregulated power supply voltage $V_{cc}$ connected through a current source $I_{s1}$ and a reference voltage circuit $V_R$ to ground. A voltage output $V_o$ is connected between the current source $I_{s1}$ and the voltage reference $V_R$.

In operation, the voltage reference circuit $V_R$ produces a regulated voltage at the output $V_o$. The voltage reference circuit $V_R$ and a load $R_L$ connected to the output $V_o$ are driven by the current source $I_{s1}$. The load $R_L$ sees the substantially constant voltage of $V_R$.

Figure 2:
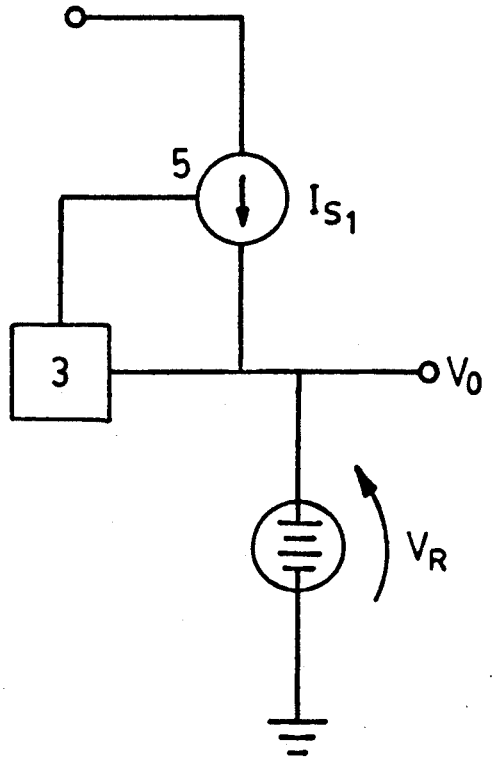
FIG. 2 is a schematic diagram of the regulator of FIG. 1 employing a feed back network.

A fixed current source $I_{s1}$ will not drive $V_R$ with a substantially constant current when the load $R_L$ varies substantially in the amount of current it draws. In FIG. 2 a feedback network 3 has been connected between $V_o$ and a current input 5 to $I_{s1}$. $I_{s1}$ is now a variable current source.

In operation, $I_{s1}$ senses the amount of current being drawn by the load $R_L$ at $V_o$ and draws current from the feedback network 3 through the input 5 to produce the required amount of current at $R_L$. It is not absolutely necessary that the feedback network 3 draw current from $V_o$, however the inventor has found this to be the most convenient way of providing the additional current. Other methods would likely require a greater number of components.

Figure 3:
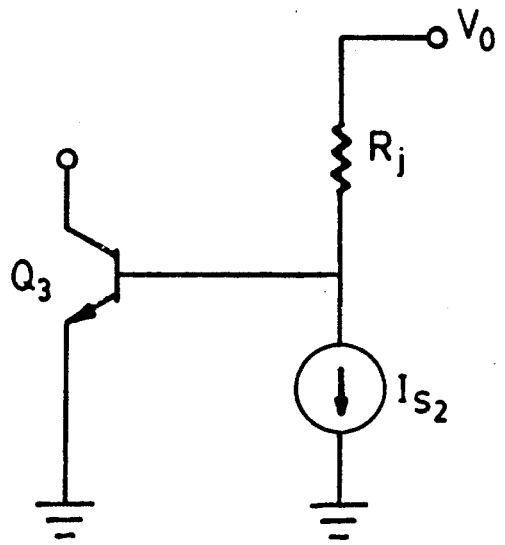
FIG. 3 is a circuit diagram of a voltage reference circuit employed in the regulators of FIG. 1 and FIG. 2.

Referring to FIG. 3, $V_R$ is made up of a BJT $Q_3$, a junction field effect transistor (JFET) resistor $R_j$ and a JFET current source $I_{s2}$. The resistor $R_j$ is connected between $V_o$ and the base of $Q_3$. The current source $I_{s2}$ is connected between the base of $Q_3$ and ground. $Q_3$ is an NPN BJT with its emitter connected to ground.

In operation, the collector of $Q_3$ would be connected to a current source such as $I_{s1}$ of FIGS. 1 and 2. The voltage across $R_j$ should be less than twice the square root of 2 times its pinch-off voltage $V_p$. However this limitation is only dependant on the number of series JFET used to make up this resistor. The current source $I_{s2}$ should be operated in the saturation region. $Q_3$ is biased in the active region therefore most of the current $I_{s2}$ goes through the resistor $R_j$. As long as substantially all of $I_{s2}$ flows through $R_j$ the resulting voltage developed will be proportional to $V_p$. The temperature coefficient of $V_p$ for a typical silicon JFET is approximately 2 mV/°C. and the temperature co-efficient of the base-emitter voltage ($V_{be}$) of a typical BJT is approximately −2 mV/°C.

$V_o$, the voltage across $V_R$, is equal to the $V_{be}$ of $Q_3$ plus $V_{rj}$. When $R_j$ is selected to produce a voltage approximately equal to the $V_p$ of $I_{s2}$ then the temperature co-efficient of $V_{rj}$ will be approximately 2 mV/°C. The temperature co-efficients of $Q_3$ (−2 mV/°C.) and $V_{rj}$ (+2 mV/°C.) will cancel to produce a substantially steady voltage with respect to temperature at $V_o$.

The −2 mV/°C. temperature co-efficient of $Q_3$ is for a typical silicon BJT. For other materials such as gallium-arsenide the temperature co-efficient will be different. This will affect the desired value of $V_p$. As $V_p$ is inversely related to the doping of a JFET, the doping of the current source of $I_{s2}$ could be altered to achieve the desired value of $V_p$.

It is not strictly necessary that $R_j$ be a JFET resistor however these resistors are preferred as their values are predominantly dependent upon size and the relationship between $I_{s2}$ and $R_j$ can be well defined when both are implemented using JFET's.

Figure 4:
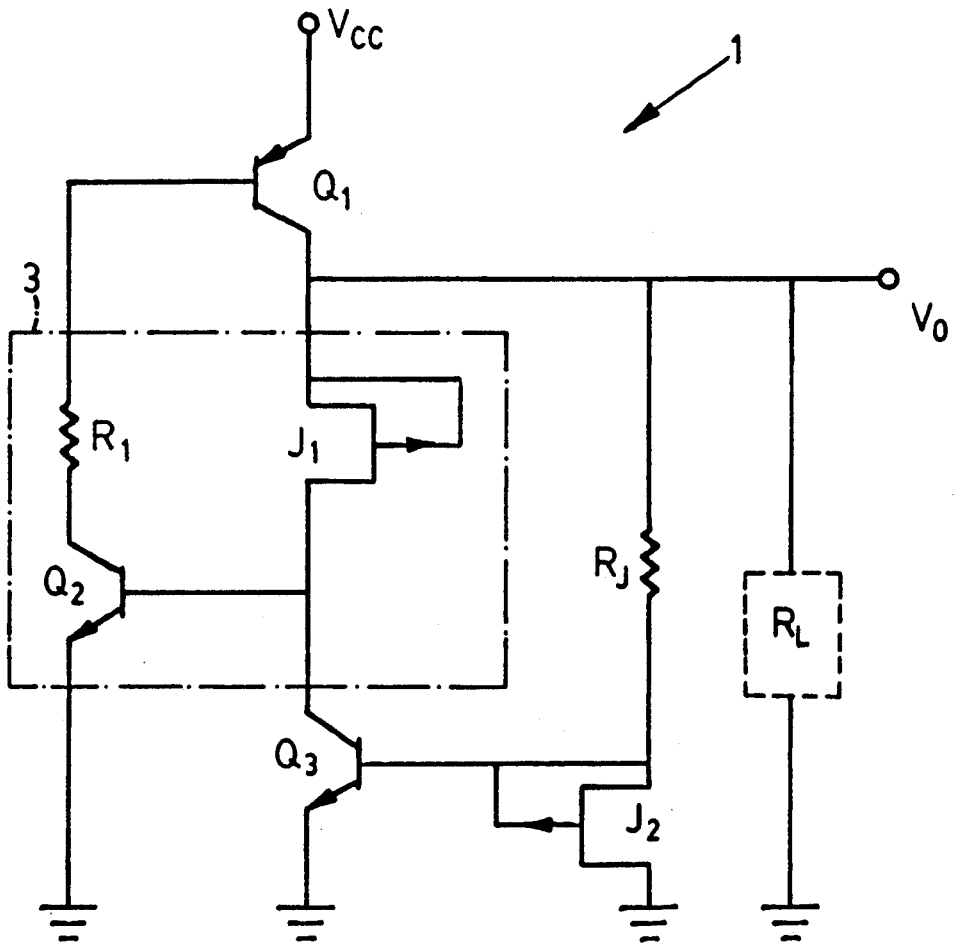
FIG. 4 is a circuit diagram of a regulator according to FIG. 2.

Referring to FIG. 4, the feedback network 3 of FIG. 2 has been included in detail. The feedback network 3, outlined in single dot chain line, is made up of a current source connected JFET $J_1$, a BJT $Q_2$ and a resistor $R_1$. The current controlled current source $I_{s1}$ has been implemented using a BJT $Q_1$. $Q_1$ is a PNP transistor with its emitter connected to $V_{cc}$ and its collector connected to $V_o$. The base of $Q_1$ is connected through $R_1$ to the collector of $Q_2$. The base of $Q_1$ is the input 5 to $I_{s1}$ of FIG. 2. $Q_2$ is an NPN transistor. The emitter of $Q_2$ is connected to ground while its base is connected between the drain of $J_1$ and the collector of $Q_3$. The gate and source of $J_1$ are connected to the collector of $Q_1$ and to $V_o$. The current source $I_{s2}$ has been implemented using a current source configured P-channel JFET $J_2$.

In operation, a load $R_L$ connected to $V_o$ will increase the current following through $Q_1$. This will increase the current in the base of $Q_1$ flowing through $R_1$ into the collector of $Q_2$. $Q_2$ acts as a variable current source drawing base current from $J_1$. The current drawn from $J_1$ will not substantially affect the $V_{be}$ of $Q_3$ as the collector of $Q_3$ has a very high impedance and the current drawn away is quite small.

The JFET $J_1$ provides fairly constant current to $Q_3$ and provides a voltage separation between the $V_{be}$ of $Q_2$ and $V_o$.

The regulator 1 and the reference circuit $V_R$ when employing silicon components are capable of operating at $V_o$ voltages down to approximately 0.9 volts. Such a voltage is obtainable using a JFET $J_2$ having a $V_p$ of approximately 0.3 volts, and a BJT $Q_3$ having a Vbe of approximately 0.6 volts in the active region.

Another important advantage of the regulator 1 and reference circuit $V_R$ made according to the preferred embodiment of the present invention is they may be implemented using fewer components then previously used in known circuits.

As well, the reference circuit $V_R$ can be configured to work equally well with reference voltages other than 0.9 volts. This technique can be extended to higher voltage applications as will be evident to those skilled in the art.

Resistor R1 functions to limit the base current of $Q_1$ thus providing short circuit protection.

It will be evident to those skilled in the art that there are other embodiments of the invention falling within its spirit and scope as defined by the following claims. Such embodiments would include complementary circuits employing reversed doping layers, such as NPN for PNP, with minor consequential amendments to the circuit configurations.

I claim:

1. A voltage reference circuit, having a voltage output, the circuit comprising: a Bipolar Junction Transistor (BJT) having a common emitter; a Junction Field Effect Transistor (JFET) current source having a given pinch-off voltage; and a JFET resistor; wherein, the current source is connected to the base of the BJT, the JFET resistor is connected between the voltage output and the base of the BJT, and the JFET resistor is selected to produce a voltage approximately equal to the pinch-off voltage of the current source when the circuit is biased in an operating condition.

2. A voltage reference circuit according to claim 1, wherein the JFET resistor is biased in the linear region in the operating condition.

3. A voltage reference circuit according to claim 2, wherein the current source is biased in the saturation region in the operating condition.

4. A voltage reference circuit according to claim 3, wherein the BJT, current source and resistor are formed substantially from silicon.

5. A voltage reference circuit according to claim 3, wherein the BJT is an NPN BJT and the current source is a p-channel JFET.

6. A voltage regulator, having a voltage output, the regulator comprising:

a first current source;

a first BJT having a common emitter;

a JFET second current source; and a JFET resistor wherein, the second current source is connected to the base of the first BJT, the JFET resistor is connected between the voltage output and the base of the first BJT, the first current source is connected to the voltage output, the first current source drives the collector of the first BJT, and the JFET resistor is selected to produce a voltage approximately equal to the pinch-off voltage of the second current source when the circuit is biased in an operating condition.

7. A voltage regulator according to claim 6, wherein the JFET resistor is biased in the linear region in the operating condition.

8. A voltage regulator according to claim 7, wherein the second current source is biased in the saturation region in the operating condition.

9. A voltage regulator according to claim 8, wherein the first current source is variable and has a current input, the regulator further comprising, a feedback network connected to the control current input.

10. A voltage regulator according to claim 9, wherein the first current source is a common emitter second BJT with its collector providing the connection to the voltage output and driving the collector of the first BJT, and its base being the control current input.

11. A voltage regulator according to claim 10, wherein the feedback network comprises, a variable third current source connected to the current input.

12. A voltage regulator according to claim 11, wherein the feedback network further comprises a voltage buffer, and wherein the third current source is a common emitter third BJT, the base of the third BJT being connected to the collector of the first BJT, the collector of the third BJT being connected to the current input, and the voltage buffer being connected between the collector of the second BJT and the collector of the first BJT.

13. A voltage regulator according to claim 12, wherein the voltage buffer comprises, a current source connected second JFET.

14. A voltage regulator according to claim 13, wherein the feedback network further comprises, a second resistor between the current input and the collector of the third BJT.

15. A voltage regulator according to claim 14, wherein the first and third BJTs are NPN, the second BJT is PNP, and the first and second JFETs are p-channel.

* * * * *